US012253318B1

(12) United States Patent
Ahn et al.

(10) Patent No.: US 12,253,318 B1
(45) Date of Patent: Mar. 18, 2025

(54) CANNON HAVING LASER IGNITION SYSTEM AND BREECH WINDOW CLEANING SYSTEM

(71) Applicant: AGENCY FOR DEFENSE DEVELOPMENT, Daejeon (KR)

(72) Inventors: Sangtae Ahn, Daejeon (KR); Yongseon Lee, Daejeon (KR); Yunjung Oh, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 0 days.

(21) Appl. No.: 18/941,935

(22) Filed: Nov. 8, 2024

(30) Foreign Application Priority Data

May 22, 2024 (KR) ..... 10-2024-0066417

(51) Int. Cl.

| | |
|---|---|
| ***F41A 13/04*** | (2006.01) |
| ***F41A 3/10*** | (2006.01) |
| ***F41A 19/58*** | (2006.01) |
| ***F41F 1/00*** | (2006.01) |

(52) U.S. Cl.
CPC ..... *F41A 13/04* (2013.01); *F41A 3/10* (2013.01); *F41A 19/58* (2013.01); *F41F 1/00* (2013.01)

(58) Field of Classification Search
CPC .. F41A 3/10; F41A 13/04; F41A 19/58; F41F 1/00
USPC ..... 89/28.05, 28.1
See application file for complete search history.

(56) References Cited

U.S. PATENT DOCUMENTS

| | | | | |
|---|---|---|---|---|
| 3,685,392 A * | 8/1972 | Platt | F41A 19/58 | 42/76.01 |
| 5,179,246 A * | 1/1993 | Betts | F42B 3/113 | 102/202 |
| 5,617,444 A * | 4/1997 | Houde-Walter | F41H 13/005 | 372/77 |
| 8,218,597 B1 * | 7/2012 | Fay | H01S 3/025 | 372/69 |
| 8,594,147 B1 * | 11/2013 | Burke | F41A 19/63 | 372/75 |

(Continued)

FOREIGN PATENT DOCUMENTS

| | | |
|---|---|---|
| JP | H-08165978 A | 6/1996 |
| KR | 100384537 B1 | 5/2003 |
| KR | 20140038221 A | 3/2014 |

(Continued)

*Primary Examiner* — Bret Hayes
(74) *Attorney, Agent, or Firm* — Osha Bergman Watanabe & Burton LLP

(57) ABSTRACT

Disclosed is a cannon including: a barrel having a chamber in which a shell and a propelling charge are mounted; a breech ring connected to the rear of the barrel, and having a shell inlet communicating with the chamber; a recoil buffer disposed on an outer circumferential surface of the barrel, and guiding recoiling and returning motions of the barrel; a breechblock connected to the breech ring, and moving relative to the breech ring between a closed position closing the shell inlet and an open position opening the shell inlet; a laser ignition device including a laser portion disposed in the breechblock and emitting a laser to ignite the propelling charge, and a breech window covering the laser portion and allowing the laser to be transmitted into the chamber; and a breech window cleaning device cleaning the breech window.

7 Claims, 10 Drawing Sheets

(56) References Cited

U.S. PATENT DOCUMENTS

| | | | | |
|---|---|---|---|---|
| 2003/0047101 | A1* | 3/2003 | Folsom | F42B 3/113<br>102/201 |
| 2006/0065110 | A1* | 3/2006 | Ireland | F41A 1/06<br>89/17 |

FOREIGN PATENT DOCUMENTS

| | | | |
|---|---|---|---|
| KR | 101433063 | B1 | 8/2014 |
| KR | 101649405 | B1 | 8/2016 |
| KR | 101755784 | B1 | 7/2017 |
| KR | 102164993 | B1 | 10/2020 |

* cited by examiner

CANNON HAVING LASER IGNITION SYSTEM AND BREECH WINDOW CLEANING SYSTEM

CROSS-REFERENCE TO RELATED APPLICATIONS

This application claims priority under 35 USC § 119 (a) to Korean Patent Application No. 10-2024-0066417 filed on May 22, 2024, in the Korean Intellectual Property Office, the disclosure of which is incorporated by reference herein in its entirety.

BACKGROUND

1. Field

The following description relates to a cannon having a laser ignition device and a breech window cleaning device.

2. Description of Related Art

In general, a cannon ignites a propelling charge and fires a shell using the pressure of the ignited propelling charge. A typical method of percussing a primer to ignite the propelling charge may require extraction and resupply of the primer, which may consume human labor and costs and may cause the propelling charge to misfire or fire at an unintended time.

A laser ignition method, which may replace a typical firing method, has been proposed to automate the operation of the cannon and reduce the costs. However, it still has a disadvantage that soot generated at each firing on a breech window through which a laser is transmitted has to be cleaned. Another disadvantage is that a laser portion disposed in a breechblock is electrically interrupted while a barrel recoils and returns during the firing and while the breechblock is opened and closed.

The above description is information the inventor(s) acquired in the course of conceiving the present disclosure, or already possessed at the time, and is not necessarily art publicly known before the present application was filed.

SUMMARY

An object of the present disclosure is to provide a cannon having a breech window cleaning device that cleans soot from a breech window.

An object of the present disclosure is to provide a cannon having a structure for transmitting a laser oscillating signal to a laser portion disposed in a breechblock.

According to an embodiment, there is provided a cannon including: a barrel having a chamber in which a shell and a propelling charge are mounted; a breech ring connected to the rear of the barrel, and having a shell inlet communicating with the chamber such that the shell and the propelling charge are loaded into the barrel; a recoil buffer disposed on an outer circumferential surface of the barrel and configured to guide recoiling and returning motions of the barrel; a breechblock connected to the breech ring, and moving relative to the breech ring between a closed position that closes the shell inlet and an open position that opens the shell inlet; a laser ignition device including a laser portion disposed in the breechblock and configured to emit a laser to ignite the propelling charge, and a breech window covering the laser portion and allowing the laser to be transmitted into the chamber; and a breech window cleaning device configured to clean the breech window. The breech window may face the chamber when the breechblock is at the closed position, and may be exposed to the outside when the breechblock is at the open position. The breech window cleaning device may be configured to clean the breech window when the breechblock is at the open position.

The breech window cleaning device may be mounted on the recoil buffer.

The breech window cleaning device may include a supply portion configured to supply a cleaning fluid or high-pressure air; and a spray nozzle connected to the supply portion to face the breech ring and configured to spray the cleaning fluid or high-pressure air.

The spray nozzle may be connected to the supply portion such that a direction in which the cleaning fluid or high-pressure air is to be sprayed is adjusted.

The cannon may further include a controller. The controller may be configured to operate the breech window cleaning device when the barrel is at a returned position and the breechblock is at the open position.

The cannon may further include a controller; and an electrical contact portion configured to receive a laser oscillating signal from the controller. The electrical contact portion may include: a laser contact portion disposed in the laser portion and configured to receive the laser oscillating signal; a first electrical contact portion disposed in the breechblock and electrically connected to the laser contact portion; a second electrical contact portion disposed in the breech ring and electrically connected to the first electrical contact portion when the breechblock is at the closed position; and a third electrical contact portion disposed in the recoil buffer and electrically connected to the second electrical contact portion when the barrel is at a returned position. The controller may be connected to the third electrical contact portion and configured to transfer the laser oscillating signal to the third electrical contact portion.

The first electrical contact portion may include: a first spring member; a 1-1 contact member connected to one end of the first spring member to face the laser contact portion; and a 1-2 contact member connected to the other end of the first spring member opposite the 1-1 contact member. The second electrical contact portion may include: a second spring member; a 2-1 contact member connected to one end of the second spring member to face the 1-2 contact member; and a 2-2 contact member connected to the other end of the second spring member opposite the 2-1 contact member.

The cannon according to embodiments described herein may use a breech window cleaning device to clean a breech window that is exposed to the outside when a breechblock is opened.

The cannon according to embodiments described herein may use an electrical contact to electrically connect a controller and a laser portion, thereby transferring a laser oscillating signal.

BRIEF DESCRIPTION OF THE DRAWINGS

The above and other features of certain embodiments of the present disclosure will be more apparent from the following detailed description, taken in conjunction with the accompanying drawings, in which.

DETAILED DESCRIPTION

Figure 1:
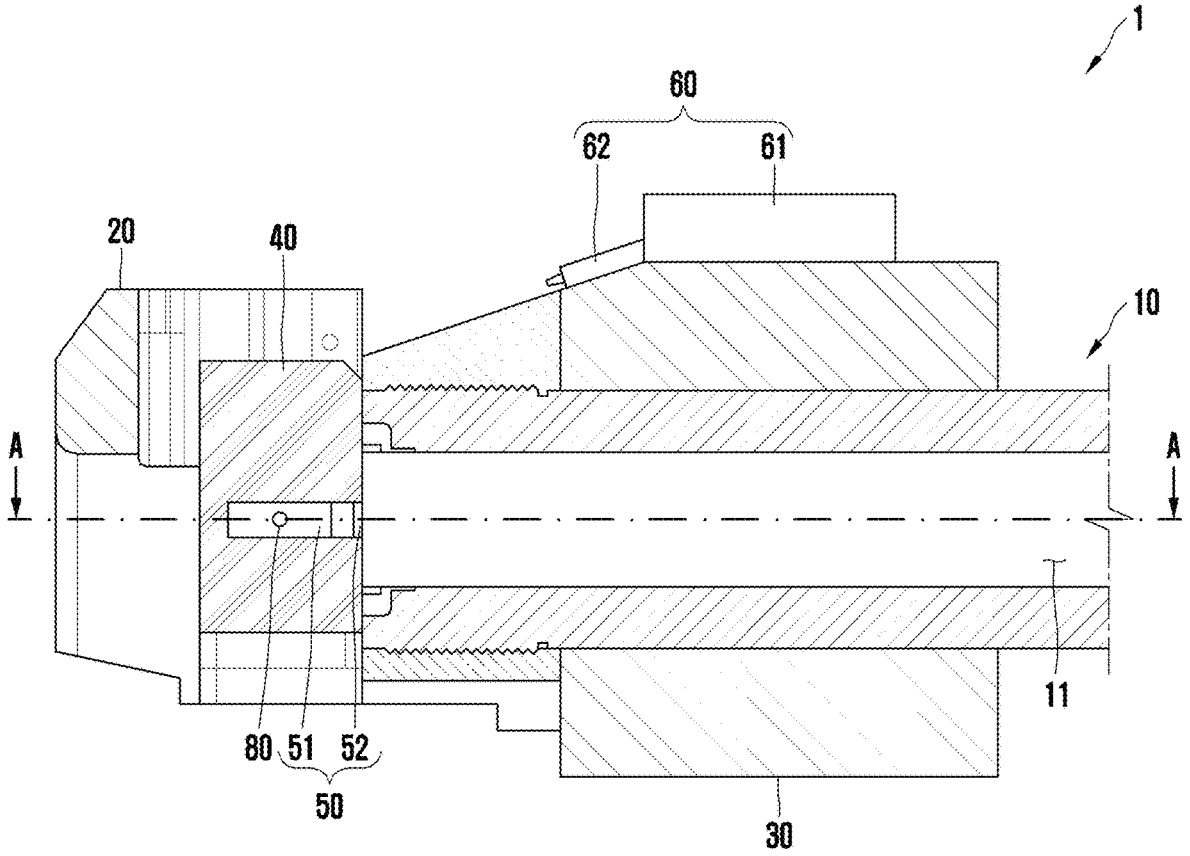
FIG. 1 is a schematic cross-sectional view of a cannon according to an embodiment.

Hereinafter, embodiments will be described in detail with reference to the accompanying drawings. However, various changes may be made to the embodiments, and the scope of claims of the present disclosure is not limited or circumscribed by these embodiments. It should be understood that any modifications, equivalents, or substitutions to the embodiments are included in the scope of the claims.

The terminology used in the embodiments is for illustrative purposes only and should not be construed as limiting. As used herein, the singular forms are intended to include the plural forms as well, unless the context clearly indicates otherwise. It should be further understood that the terms "comprise," "comprising," "include," and/or "including," when used in this disclosure, specify the presence of stated features, integers, steps, operations, elements, components, or a combination thereof, but do not preclude the presence or addition of one or more other features, integers, steps, operations, elements, components, and/or groups thereof.

Unless otherwise defined herein, all terms used herein including technical or scientific terms have the same meanings as those generally understood by one of ordinary skill in the art. Terms defined in generally used dictionaries should be construed to have meanings matching with contextual meanings in the related art and are not to be construed as an ideal or excessively formal meaning unless otherwise defined herein.

However, when describing the embodiments with reference to the accompanying drawings, identical components are given the same reference numerals regardless of the designations in the drawings, and detailed descriptions of well-known functions or configurations will be omitted for the clarity of the gist of the present disclosure.

Although terms of "first," "second," A, B, (a), and (b) are used to explain various components, the components are not limited to the terms. These terms should be used only to distinguish one component from another component, and do not define the nature, sequence, or order of the components. It is to be understood that, when a component is referred to as being "connected to" another component, the component can be directly connected or coupled to the other component, or intervening components may be present therebetween.

Also, components included in an embodiment, and components having common features, are described using the same designations in other embodiments. Unless otherwise indicated, the description of one embodiment applies to the other embodiments, and a detailed description thereof is omitted when it is deemed to be redundant.

FIG. 1 is a schematic cross-sectional view of a cannon according to an embodiment.

Figure 2A:
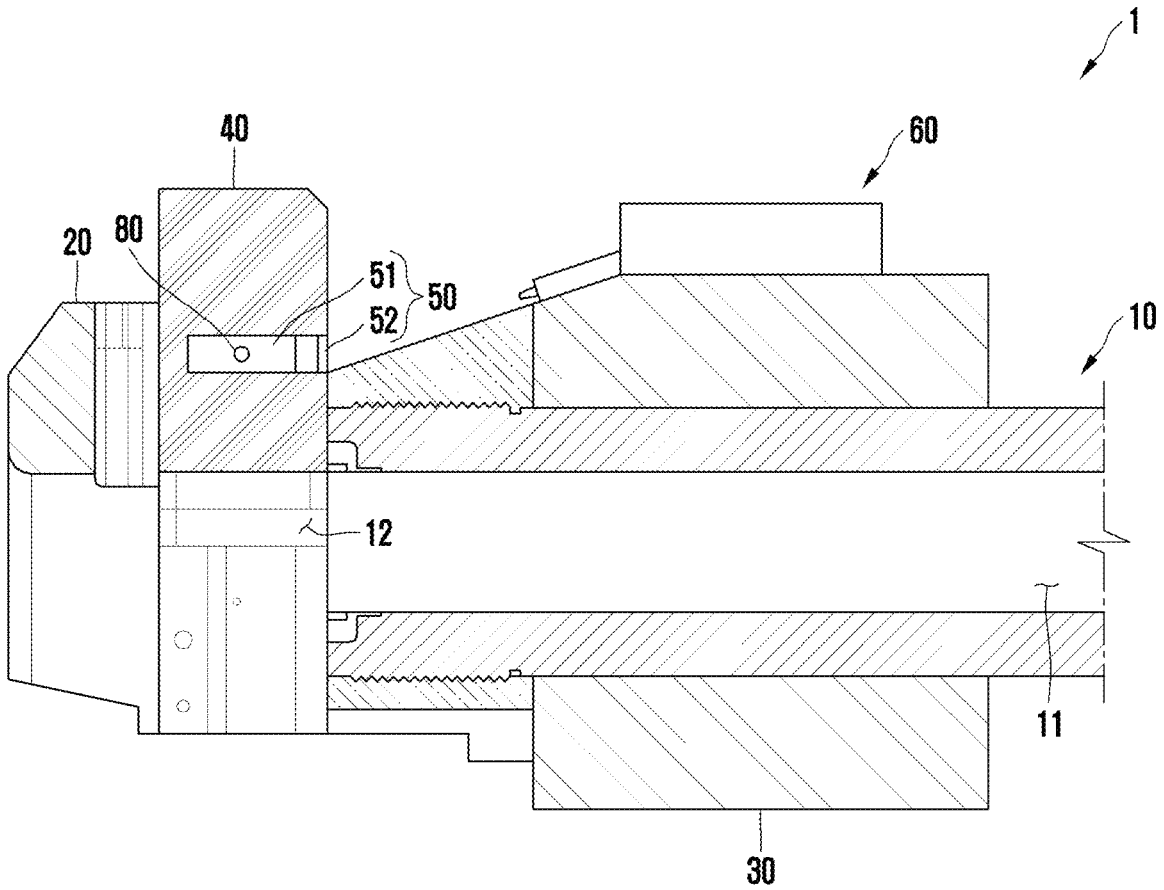
FIGS. 2A and 2B are schematic views of a cannon shown with a breechblock at an open position and with a barrel at a recoiled position, respectively, according to an embodiment.
Figure 2B:
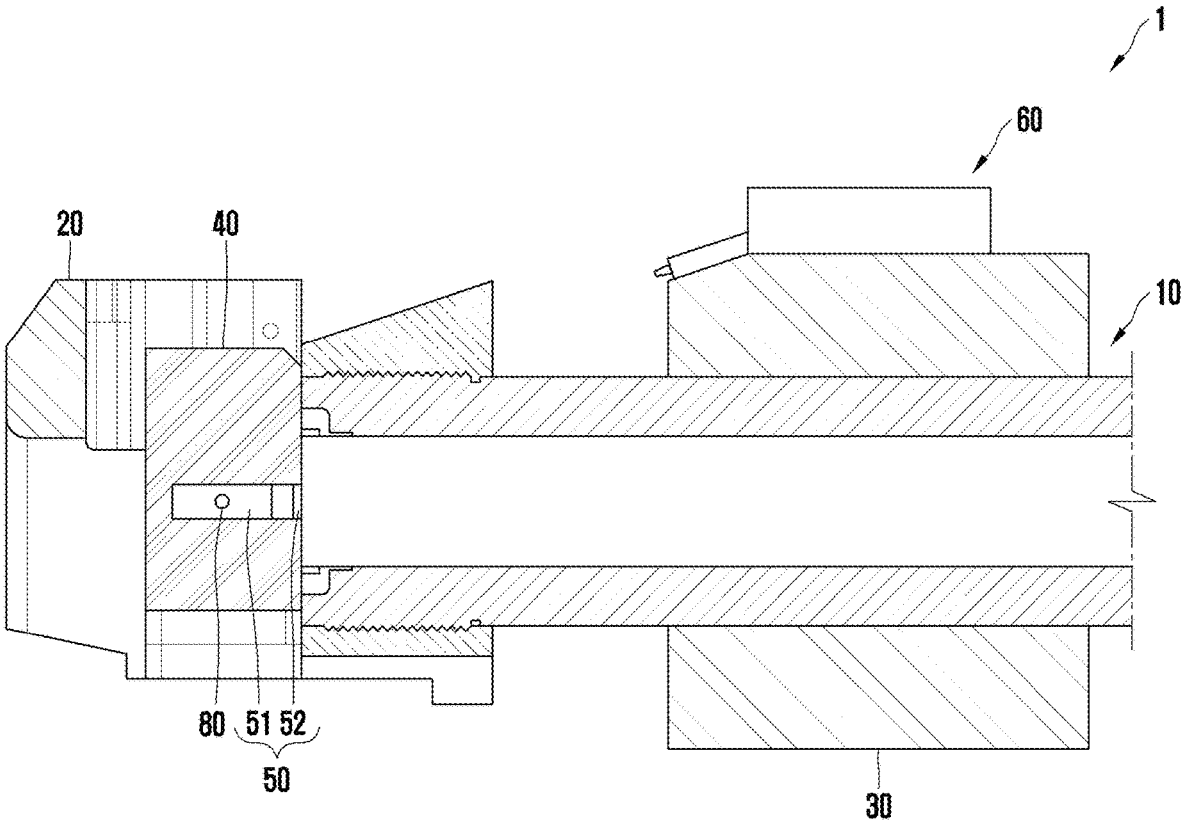
Figure 3:
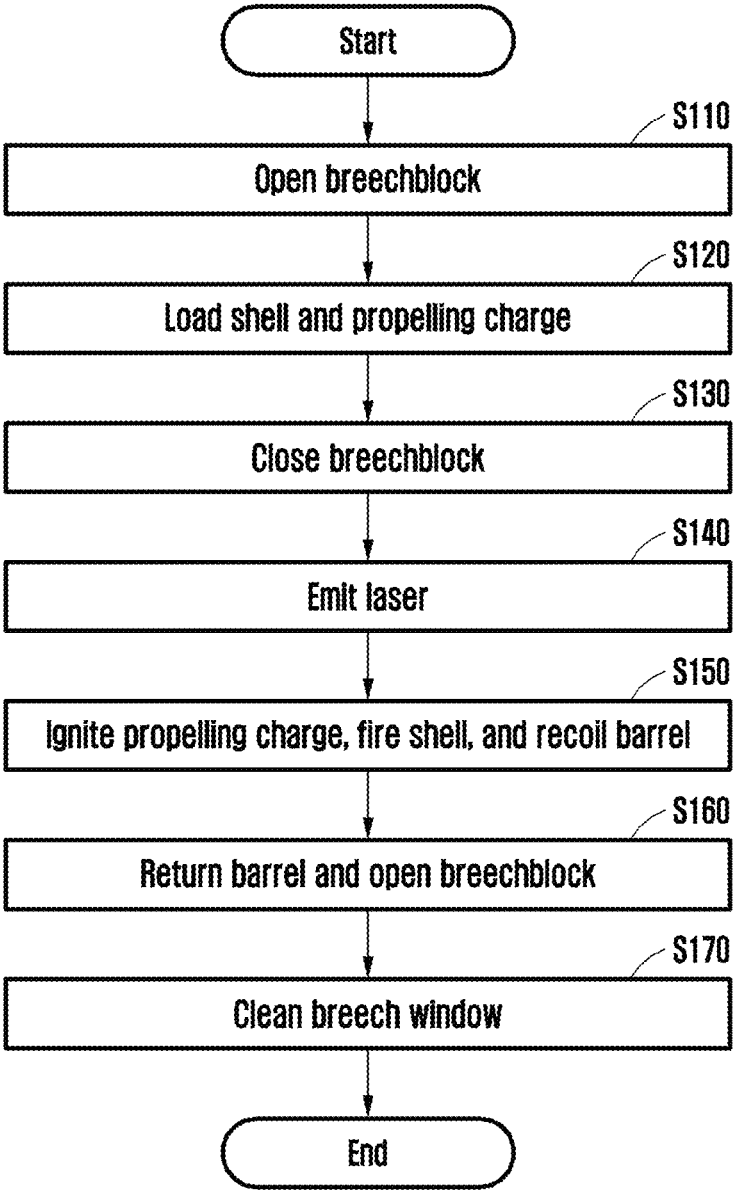
FIG. 3 is a flowchart illustrating how a cannon operates according to an embodiment.
Figure 4:
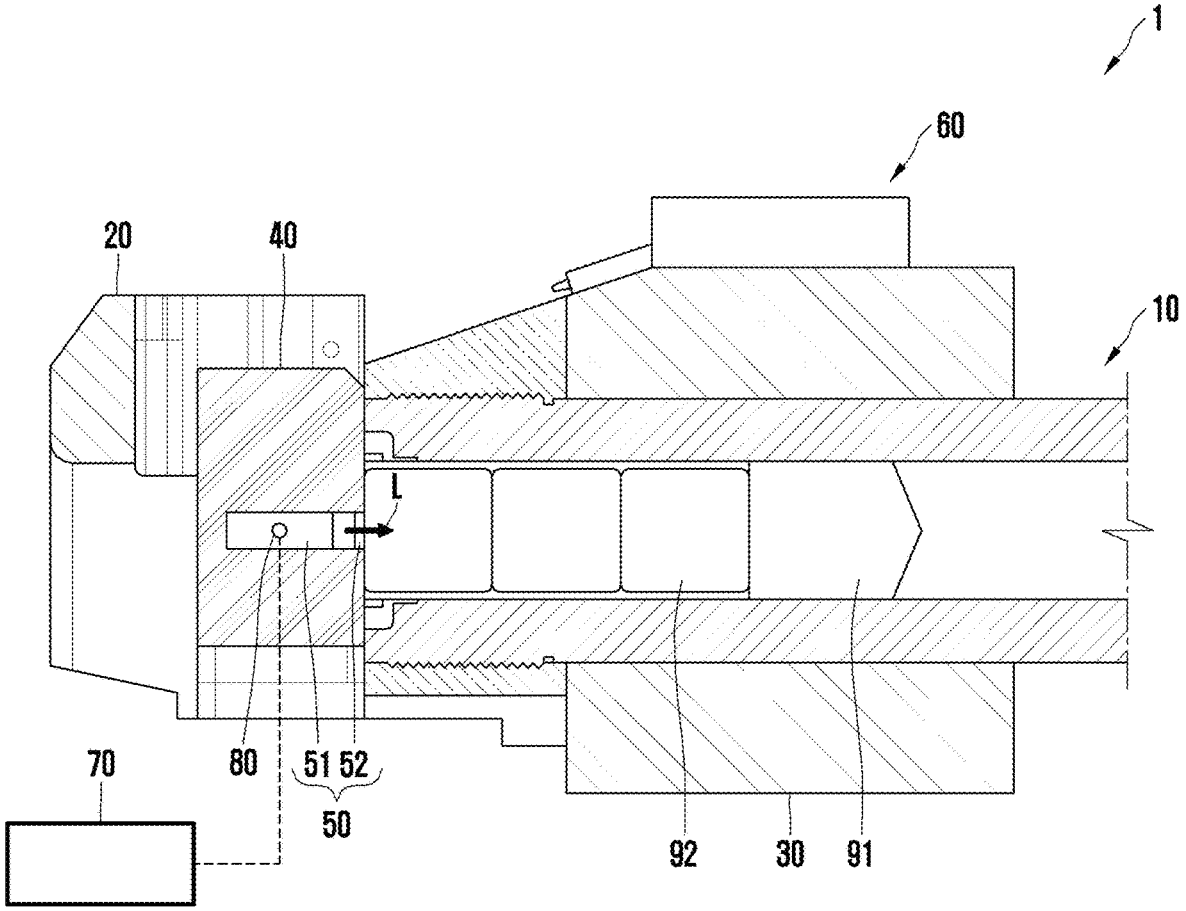
FIG. 4 is a schematic view of a cannon illustrating how a laser emitted from a laser ignition device ignites a propelling charge according to an embodiment.
Figure 5:
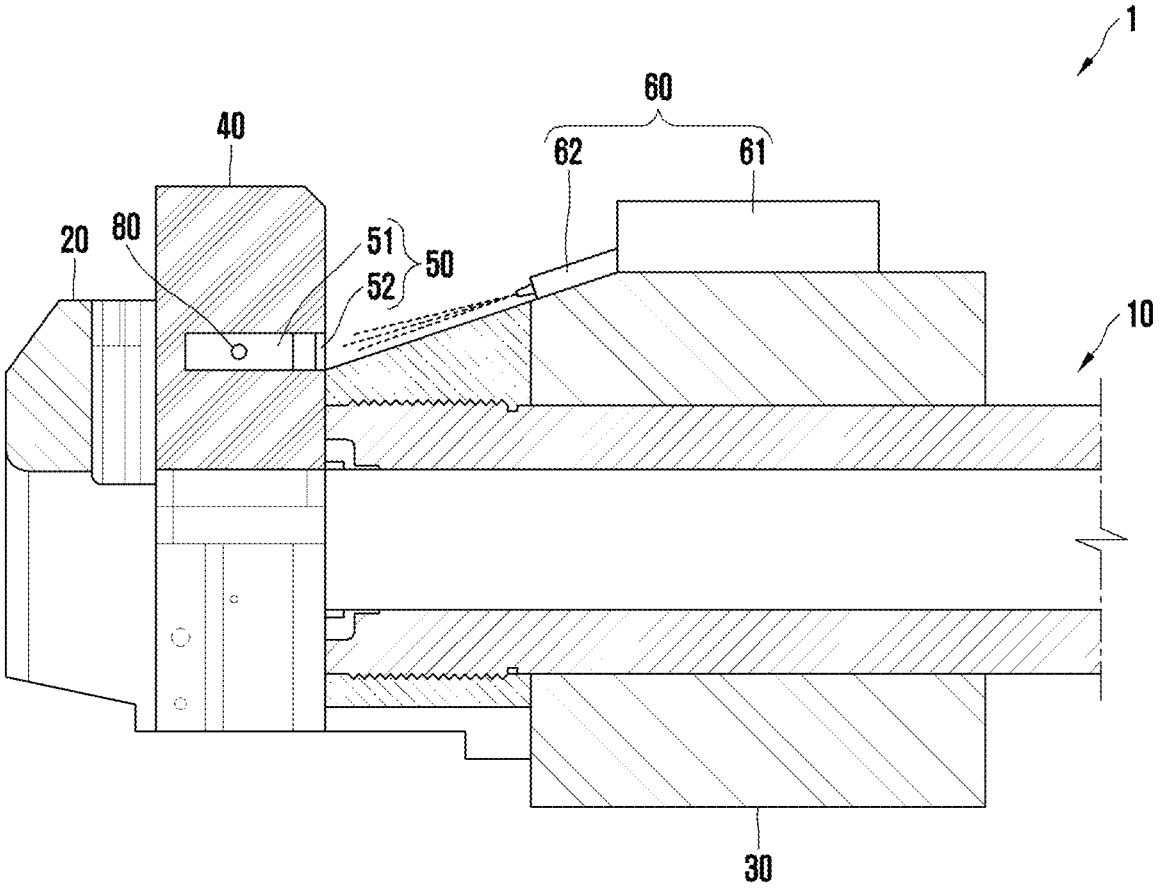
FIG. 5 is a schematic view of a cannon illustrating how a breech window cleaning device cleans a breech window when a breechblock is at an open position according to an embodiment.
Figure 6:
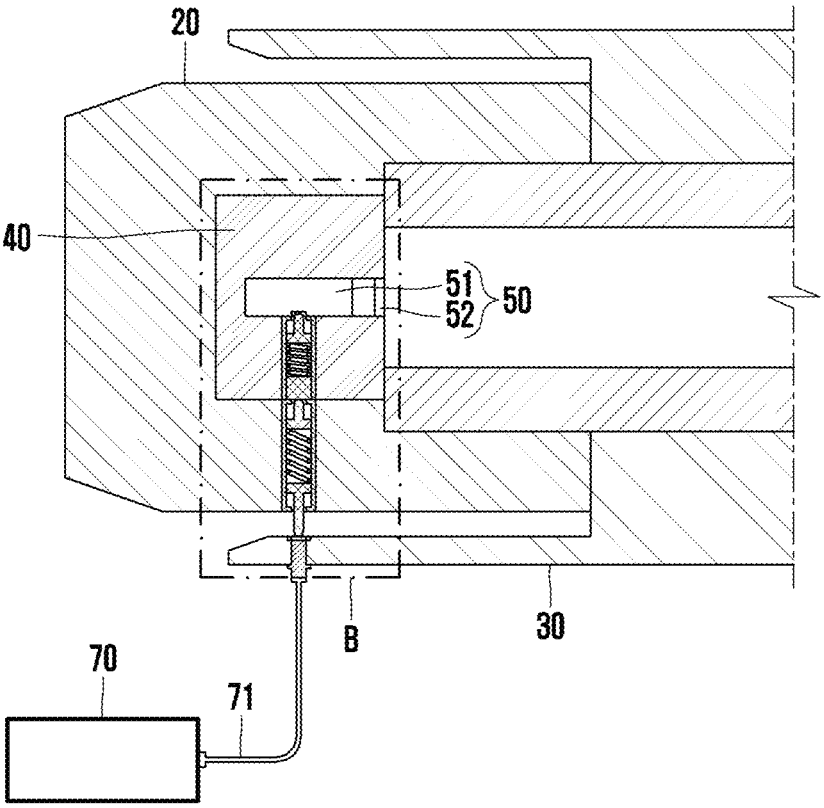
FIG. 6 is a schematic cross-sectional view of a cannon acquired in direction A along a broken line relative to an electrical contact of FIG. 1, according to an embodiment.
Figure 7:
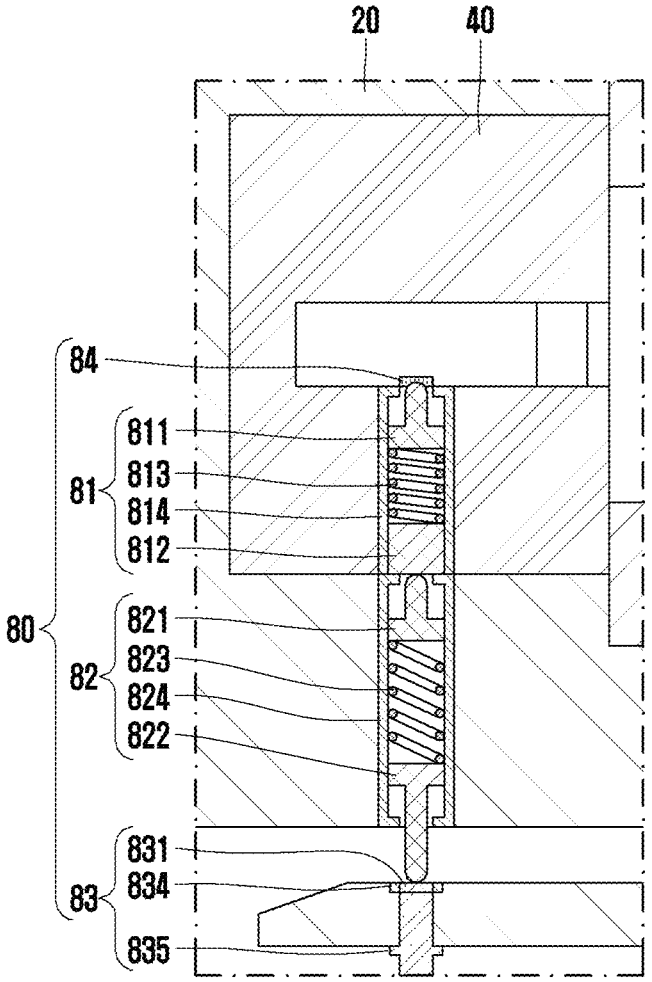
FIG. 7 is a view of a cannon acquired by enlarging portion B of FIG. 6, according to an embodiment.
Figure 8A:
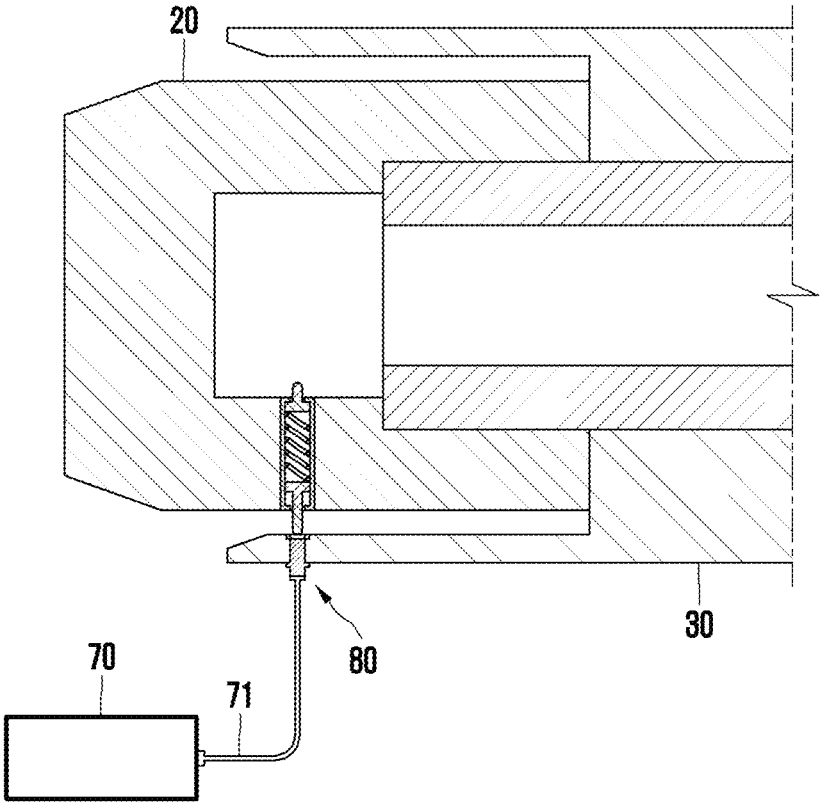
FIGS. 8A and 8B are schematic cross-sectional views of a cannon shown with a breechblock at an open position and with a barrel at a recoiled position, respectively, with respect to an electrical contact, according to an embodiment.
Figure 8B:
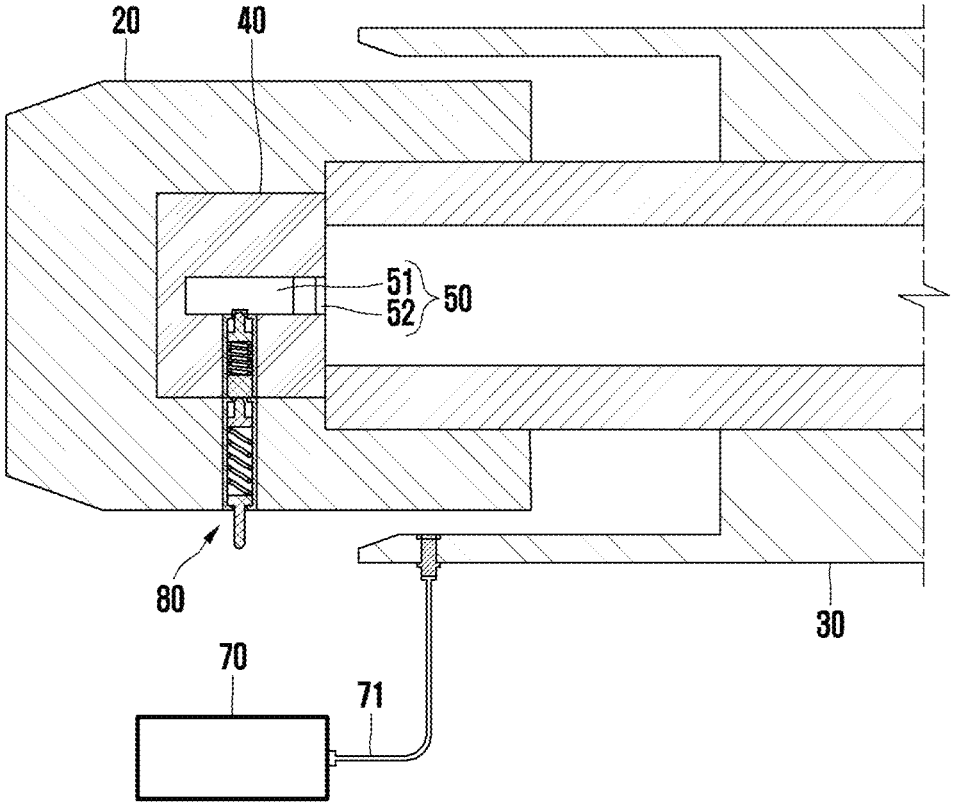

FIGS. 2A and 2B are schematic views of a cannon shown with a breechblock at an open position and with a barrel at a recoiled position, respectively, according to an embodiment. FIG. 3 is a flowchart illustrating how a cannon operates according to an embodiment. FIG. 4 is a schematic view of a cannon illustrating how a laser emitted from a laser ignition device ignites a propelling charge according to an embodiment. FIG. 5 is a schematic view of a cannon illustrating how a breech window cleaning device cleans a breech window when a breechblock is at an open position according to an embodiment. FIG. 6 is a schematic cross-sectional view of a cannon acquired in direction A along a broken line relative to an electrical contact of FIG. 1, according to an embodiment. FIG. 7 is a view of a cannon acquired by enlarging portion B of FIG. 6, according to an embodiment. FIGS. 8A and 8B are schematic cross-sectional views of a cannon shown with a breechblock at an open position and with a barrel at a recoiled position, respectively, with respect to an electrical contact, according to an embodiment.

Referring to FIGS. 1, and 2A and 2B, according to an embodiment, a cannon 1 may fire a shell 91. For example, the cannon 1 may be equipped with the shell 91 and a propelling charge 92 for firing the shell 91. The cannon 1 may ignite the propelling charge 92 through a laser, and may fire the shell 91 along a set trajectory by the pressure from the ignition of the propelling charge 92.

The cannon 1 may include a barrel 10, a breech ring 20, a recoil buffer 30, a breechblock 40, a laser ignition device 50, a breech window cleaning device 60, a controller 70, and an electrical contact portion 80.

In an embodiment, the barrel 1 may have a chamber 11 formed therein in which the shell 91 and the propelling charge 92 are mounted. The barrel 10 may be formed to extend in a longitudinal direction of the chamber 11. For example, the barrel 10 may be provided in the form of a cylinder extending in the longitudinal direction of the chamber 11. The chamber 11 may be open at both ends of the barrel 10. For example, at one end of the barrel 10 that faces forward, an opening may be formed through which the shell 91 is fired along the chamber 11. At the other end of the barrel 10 that faces rearward, the breech ring 20 may be connected. The shell 91 may be loaded into the chamber 11 through the other open end of the barrel 10.

In an embodiment, the breech ring 20 may be connected to the rear of the barrel 10. The breech ring 20 may have a shell inlet 12 that communicates with the chamber 11 and is formed for the shell 91 to be loaded therein. For example, in the process of using the cannon 1, the shell 91 and the propelling charge 92 may be sequentially loaded into the chamber 11 through the shell inlet 12 formed in the breech ring 20.

In an embodiment, the recoil buffer 30 may be disposed on an outer circumferential surface of the barrel 10. The recoil buffer 30 may be connected to the barrel 10 such that it surrounds the outer circumferential surface of the barrel 10. The recoil buffer 30 may guide recoiling and returning motions of the barrel 10 and the breech ring 20 during firing of the shell 91. For example, when the shell 91 is fired, the barrel 10 and the breech ring 20 may recoil relative to the recoil buffer 30 in response to the firing of the shell 91 to absorb an impact by such a reaction, and may return to their original positions. In this case, the recoil buffer 30 may guide the recoiling and returning motions of the barrel 10 and the breech ring 20 to maintain a position of the barrel 10 between a recoiled position (refer to FIG. 2B) and a returned position (refer to FIG. 1) as the barrel 10 recoils and returns.

In an embodiment, the breechblock 40 may open and close the shell inlet 12. The breechblock 40 may be moveably connected to the breech ring 20. For example, the breechblock 40 may move between a closed position (refer to FIG. 1) that closes the shell inlet 12 relative to the breech ring 20 and an open position (refer to FIG. 2A) that opens the shell inlet 12. For example, the breechblock 40 may ascend with respect to the breech ring 20 to open the shell inlet 12 at the open position, and may descend with respect to the breech ring 20 to close the shell inlet 12 at the closed position. When the breechblock 40 is at the closed position, the breechblock 40 may close the other end of the chamber 11 facing the shell inlet 12 and may thereby prevent the pressure generated by the combustion of the propelling charge 92 from leaking out to the rear of the barrel 10. When the breechblock 40 is at the open position, the shell 91 and the propelling charge 92 may be loaded into the chamber 11 through the shell inlet 12.

In an embodiment, the laser ignition device 50 may ignite the propelling charge 92 disposed in the chamber 11. The laser ignition device 50 may be disposed in the breechblock 40. As the breechblock 40 moves relative to the breech ring 20, a position of the laser ignition device 50 may be adjusted along with the breechblock 40. For example, the laser ignition device 50 may face the chamber 11 when the breechblock 40 is at the closed position and may be exposed outside the cannon 1 when the breechblock 40 is at the open position.

The laser ignition device 50 may include a laser portion 51 and a breech window 52. The laser portion 51 may emit (or oscillate) laser to ignite the propelling charge 92. The laser portion 51 may emit the laser toward the chamber 11 when the breechblock 40 is at the closed position. The laser portion 51 may be electrically connected to the controller 70 through the electrical contact portion 80, which will be described later. The laser portion 51 may receive a laser oscillating signal from the controller 70.

The breech window 52 may cover the laser portion 51. Based on the closed position of the breechblock 40, the breech window 52 may be disposed between the laser portion 51 and the chamber 11. Based on the open position of the breechblock 40, the breech window 52 may be exposed to the outside of the breech ring 20. The laser emitted from the laser portion 51 may be emitted by being transmitted through the breech window 52. When the laser portion 51 ignites the propelling charge 92 mounted in the chamber 11, the breech window 52 may allow the laser emitted from the laser portion 51 to be transmitted while protecting the laser portion 51 from the heat and pressure generated by the combustion of the propelling charge 92. The breech window 52 may be formed of a laser-transmissive material through which the laser may be transmitted. Although only one breech window 52 is shown in the drawings for ease of explanation, the breech window 52 may be provided as a plurality of breech windows 52 which may be arranged in parallel to cover the laser portion 51.

The breech window cleaning device 60 may clean the breech window 52. For example, the breech window cleaning device 60 may remove soot or debris that remains on the breech window 52 after the firing of the cannon 1. As the breech window 52 is cleaned by the breech window cleaning device 60, the laser may be more effectively transmitted through the breech window 52.

The breech window cleaning device 60 may be disposed outside the chamber 11. For example, the breech window cleaning device 60 may be mounted on the recoil buffer 30. In a case where the recoil buffer 30 is fixed to the ground, the breech window cleaning device 60 may be fixed at a constant position regardless of whether the barrel 10 performs the recoiling and returning motions relative to the recoil buffer 30 or whether the breechblock 40 is open or closed. The breech window cleaning device 60 may be configured to clean the breech window 52 when the breechblock 40 is at the open position, for example, when the breech window 52 is exposed to the outside of the breech ring 20.

A process in which the cannon 1 operates will be described below with reference to FIG. 3.

In describing the process of the cannon 1, at least one of the steps illustrated in FIG. 3 may be omitted. At least two or more of the steps illustrated in FIG. 3 may be performed simultaneously. At least one or more of the steps illustrated in FIG. 3 may be repeated. It is to be noted that, unless otherwise stated, the steps illustrated in FIG. 3 are not necessarily performed in sequential order.

In step S110, the breechblock 40 may be opened. In step S110, as the breechblock is moved to an open position with respect to the breech ring 20, the shell inlet 12 of the breech ring 20 may be opened.

In step S120, the shell 91 and the propelling charge 92 may be sequentially loaded into the chamber 11 through the shell inlet 12 that is open.

In step S130, the breechblock 40 may be closed. As the breechblock 40 is moved to a closed position with respect to the breech ring 20, the shell inlet 12 of the breech ring 20 may be closed. With the breechblock 40 closed, the laser portion 51 disposed in the breechblock may be arranged to face the chamber 11. The laser portion 51 may be covered by the breech window 52.

In step S140, the laser portion 51 may emit (or oscillate) a laser toward the chamber 11. The laser emitted from the laser portion 51 may penetrate the breech window 52 to be emitted into the chamber 11.

In step S150, the propelling charge 92 may be ignited by the laser emitted by the laser portion 51. In this case, the pressure from the ignition of the propelling charge 92 may allow the shell 91 to be fired from the cannon 1. The pressure from the firing of the shell 91 may allow the barrel 10 to recoil with respect to the recoil buffer 30. Since the laser portion 51 is covered by the breech window 52, the laser portion 51 may be prevented from being damaged by soot generated by the firing of the shell 91 and the ignition of the propelling charge 92.

In step S160, the barrel 10 may return from a recoiled position to its original position. Simultaneously with such a returning motion of the barrel 11, the breechblock 40 may be moved to the open position. For example, when the return of the barrel 10 is completed, the barrel 10 may be positioned at a returned position and the breechblock 40 may be positioned at the open position. When the breechblock 40 is at the open position, the laser portion 51 and the breech window 52 mounted in the breechblock 40 may be exposed to the outside.

In step S170, the breech window 52 exposed to the outside may be cleaned. For example, the controller 70 may receive, through a sensor, information about whether the barrel is returned and whether the breechblock 40 is open, and may control the breech window cleaning device 60 to clean the breech window 52 in a state where the barrel 10 is returned and the breechblock 40 is open.

A process in which the breech window cleaning device 60 cleans the breech window 52 will be described in detail below with reference to FIGS. 4 and 5.

The laser ignition device 50 may receive a laser oscillating signal from the controller 70 when the barrel 10 is at a returned position and the breechblock 40 is at a closed position relative to the breech ring 20, as shown in FIG. 4. The laser oscillating signal generated by the controller 70 may be transferred to the laser ignition device 50 through the electrical contact portion 80. When the laser oscillating signal is transferred to the laser ignition device 50, the laser portion 51 may emit (or oscillate) a laser through the breech window 52 to ignite the propelling charge 92. Upon the ignition of the propelling charge 92, the shell 91 may be fired, and soot generated by the combustion of the propelling charge 92 may be adhered to the breech window 52. When the shell 91 is fired, the barrel 10 and the breech ring 20 may perform recoiling and returning motions as a reaction with respect to the recoil buffer 30.

When the barrel 10 and the breech ring 20 have returned to the returned position with respect to the recoil buffer 30, the breechblock 40 may move to the open position with respect to the breech ring 20. When the breechblock 40 is at the open position, the laser ignition device 50, for example, the breech window 52, may be exposed to the outside of the breech ring 20.

The breech window cleaning device 60 may be controlled by the controller 70 to clean the breech window 52 when the breech ring 20 is at the returned position and the breechblock is at the open position, as shown in FIG. 5. For example, the controller 70 may operate the breech window cleaning device 60 after receiving, through a returning detection sensor and an opening detection sensor, a returning completion signal indicating that the breech ring 20 has completed returning and an opening completion signal indicating that the breechblock 40 has completed opening.

The breech window cleaning device 60 may spray a cleaning fluid onto the breech window 52 exposed to the outside of the breech ring 20. The cleaning fluid may be, for example, water. The breech window cleaning device 60 may include a supply portion 61, and a spray nozzle 62 connected to the supply portion 61. The supply portion 61 may supply the cleaning fluid or high-pressure air to the spray nozzle 62. The spray nozzle 62 may spray the cleaning fluid or high-pressure air toward the breech window 52 being at the open position. A water pressure of the cleaning fluid sprayed from the spray nozzle 62 and an air pressure of the high-pressure air sprayed from the spray nozzle 62 may be regulated. Since the soot remaining on the breech window 52 is well removed when cleaned with water immediately after firing, the breech window cleaning device 60 may spray the cleaning fluid onto the breech window 52 to remove the soot, and then spray the high-pressure air onto the breech window 52 to dry the breech window 52.

The supply portion 61 may be arranged to be fixed to the recoil buffer 30 and may supply the cleaning fluid or high-pressure air. The supply portion 61 may further include a large container for storing a large amount of cleaning fluid or compressed air.

The spray nozzle 62 may spray the cleaning fluid or air supplied by the supply portion 61 towards the breech window 52. The spray nozzle 62 may be connected to the supply portion 61 such that it faces the breech ring 20. The spray nozzle 62 may be fixedly connected to the supply portion 61 or may be movably connected to the supply portion 61. When the spray nozzle 62 is movably connected, a direction in which the cleaning fluid or high-pressure air is sprayed may be adjusted. The spray nozzle 62 may be provided as two or more spray nozzles that spray one of the cleaning fluid and the air. Alternatively, the spray nozzle 62 may be provided as only one spray nozzle that sprays selectively one of the cleaning fluid and the air. The spray nozzle 62 may be configured to spray the cleaning fluid or air toward an area larger than the breech window 52 to clean the breech window 52 entirely. Between the spray nozzle 62 and the breech window 52, a structure having a passage through which the cleaning fluid or air travels may be disposed.

Referring to FIGS. 6, 7, and 8A and 8B, the cannon 1 may include a plurality of electrical contact portions 80 that is selectively connected. When the plurality of electrical contact portions 80 are electrically connected, the cannon 1 may be configured to transfer a laser oscillating signal from the controller 70 to the laser portion 51.

The plurality of electrical contact portions 80 may include a laser contact portion 84 disposed in the laser portion 51, a first electrical contact portion 81 disposed in the breechblock 40, a second electrical contact portion 82 disposed in the breech ring 20, and a third electrical contact portion 83 disposed in the recoil buffer 30.

In an embodiment, the laser contact portion 84 may be electrically connected to the laser portion 51. Through the laser contact portion 84, the laser oscillating signal of the controller 70 may be transferred directly to the laser portion 51.

In an embodiment, the first electrical contact portion 81 may be disposed in the breechblock 40. One end of the first electrical contact portion 81 may contact the laser contact portion 84, and the other end of the first electrical contact portion 81 opposite the laser contact portion 84 may be exposed to the outside of the breechblock 40. The first electrical contact portion 81 may include a first spring member 813, a 1-1 contact member 811 connected to one end of the first spring member 813, and a 1-2 contact member 812 connected to the other end of the first spring member 813. The 1-1 contact member 811 may be connected to face the laser contact portion 84. To transfer the laser oscillating signal, the first spring member 813, the 1-1 contact member 811, and the 1-2 contact member 812 may be electrically conductive. The first electrical contact portion 81 may include a first housing 814 formed to enclose the exterior, to electrically insulate the first electrical contact portion 81 from the recoil buffer 40. The 1-1 contact member 811 may have one end provided in the shape of a plunger protruding toward the laser contact portion 84.

The second electrical contact portion 82 may be disposed in the breech ring 20. One end of the second electrical contact portion 82 may selectively contact the other end of the first electrical contact portion 81 depending on the position of the breechblock 40 relative to the breech ring 20. For example, when the breechblock 40 is at the closed position, the second electrical contact portion 82 may come into contact with the first electrical contact portion 81 to be electrically connected to the first electrical contact portion 81. When the breechblock is at the open position, the contact with the first electrical contact portion 81 may be released and the second electrical contact portion 82 may be electrically disconnected from the first electrical contact portion 81. The other end of the second electrical contact portion 82 opposite the breechblock 40 may be exposed to the outside of the breech ring 20. The second electrical contact portion 82 may include a second spring member 823, a 2-1 contact member 821 connected to one end of the second spring member 823, and a 2-2 contact member 822 connected to the other end of the second spring member 823. The 2-1 contact member 821 may be connected to face the first electrical contact portion 81. The 2-2 contact member 822 may be connected to face the third electrical contact portion 83. To transfer the laser oscillating signal, the second spring member 823, the 2-1 contact member 821, and the 2-2 contact member 822 may be electrically conductive. The second electrical contact portion 82 may include a second housing 824 formed to enclose the exterior, to electrically insulate the second electrical contact portion 82 from the breech ring 20. The 2-1 contact member 821 and the 2-2 contact member 822 may each be provided in the shape of a plunger with one end protruding toward the laser contact portion 84 and the third electrical contact portion 83, respectively. When the breechblock 40 is at the open position, the second electrical contact portion 82 may be electrically disconnected from the first electrical contact portion 81, and the 2-1 contact member 821 may protrude (refer to FIG. 8A). When the breech ring 20 is at the recoiled position, the second electrical contact portion 82 may be electrically disconnected from the third electrical contact portion 83, and the 2-2 contact member 822 may protrude (refer to FIG. 8B).

In an embodiment, the third electrical contact portion 83 may be disposed in the recoil buffer 30. When the barrel 10 is at the returned position, the third electrical contact portion 83 may come into contact with the second electrical contact portion 82 at one end to be electrically connected to the second electrical contact portion 82. When the barrel 10 is at the recoiled position, the contact with the second electrical contact portion 82 may be released and the third electrical contact portion 83 may be electrically disconnected from the second electrical contact portion 82. The third electrical contact portion 83 may include a third contact member 831 and a cable socket 835. The third contact member 831 may be connected to face the second electrical contact portion 82. The cable socket 835 may be electrically connected to the controller 70 via a cable 71 to receive the laser oscillating signal. To transfer the laser oscillating signal, the third contact member 831 and the cable socket 835 may be electrically conductive. The third electrical contact portion 83 may include a third housing 834 formed to enclose the exterior, to electrically insulate the third electrical contact portion 83 from the recoil buffer 30.

This structure described above may connect or disconnect the second electrical contact portion 82 and the third electrical contact portion 83 depending on the recoiled/returned position of the barrel 10, and connect or disconnect the first electrical contact portion 81 and the second electrical contact portion 82 depending on the closed/open position of the breechblock 40. Therefore, only when the barrel 10 is at the returned position and the breechblock 40 is at the closed position, the first electrical contact portion 81 and the third electrical contact portion 83 may be electrically connected via the second electrical contact portion 82. Since the first electrical contact portion 81 is electrically connected to the laser contact portion 84 and the third electrical contact portion 83 is electrically connected to the controller 70, the laser oscillating signal of the controller 70 may be transferred to the laser portion 51 when the barrel 10 is at the returned position and the breechblock 40 is at the closed position.

For example, when the breechblock 40 is at the closed position and the barrel 10 is at the returned position as shown in FIG. 6, the laser oscillating signal may be transferred in sequential order: the controller 70, the cable 71, the cable socket 835, the third contact member 831, the 2-2 contact member 822, the second spring member 823, the 2-1 contact member 821, the 1-2 contact member 812, the first spring member 813, the 1-1 contact member 811, the laser contact portion 84, and the laser portion 51.

While this disclosure includes specific examples, it will be apparent after an understanding of the disclosure of this application that various changes in form and details may be made in these examples without departing from the spirit and scope of the claims and their equivalents. The embodiments described herein are to be considered in a descriptive sense only, and not for purposes of limitation. Descriptions of features or aspects in each embodiment are to be considered as being applicable to similar features or aspects in other embodiment. Suitable results may be achieved if the described techniques are performed in a different order, and/or if components in a described system, architecture, device, or circuit are combined in a different manner, and/or replaced or supplemented by other components or their equivalents.

Therefore, in addition to the above disclosure, the scope of the disclosure may also be defined by the claims and their equivalents, and all variations within the scope of the claims and their equivalents are to be construed as being included in the disclosure.

What is claimed is:

1. A cannon, comprising a barrel having a chamber in which a shell and a propelling charge are mounted;

a breech ring connected to the rear of the barrel, and having a shell inlet communicating with the chamber such that the shell and the propelling charge are loaded into the barrel;

a recoil buffer disposed on an outer circumferential surface of the barrel and configured to guide recoiling and returning motions of the barrel;

a breechblock connected to the breech ring, and moving relative to the breech ring between a closed position that closes the shell inlet and an open position that opens the shell inlet;

a laser ignition device comprising a laser portion disposed in the breechblock and configured to emit a laser to ignite the propelling charge, and a breech window covering the laser portion and allowing the laser to be transmitted into the chamber; and a breech window cleaning device configured to clean the breech window, wherein the breech window faces the chamber when the breechblock is at the closed position, and is exposed outside the chamber when the breechblock is at the open position, and the breech window cleaning device is configured to clean the breech window when the breechblock is at the open position.

2. The cannon of claim 1, wherein the breech window cleaning device is mounted on the recoil buffer.

3. The cannon of claim 2, wherein the breech window cleaning device comprises:

a supply portion configured to supply a cleaning fluid or high-pressure air; and a spray nozzle connected to the supply portion to face the breech ring and configured to spray the cleaning fluid or high-pressure air.

4. The cannon of claim 3, wherein the spray nozzle is connected to the supply portion such that a direction in which the cleaning fluid or high-pressure air is to be sprayed is adjusted.

5. The cannon of claim 1, further comprising:

a controller, wherein the controller is configured to operate the breech window cleaning device when the barrel is at a returned position and the breechblock is at the open position.

6. The cannon of claim 1, further comprising:

a controller; and an electrical contact portion configured to receive a laser oscillating signal from the controller, wherein the electrical contact portion comprises:

a laser contact portion disposed in the laser portion and configured to receive the laser oscillating signal;

a first electrical contact portion disposed in the breechblock and electrically connected to the laser contact portion;

a second electrical contact portion disposed in the breech ring and electrically connected to the first electrical contact portion when the breechblock is at the closed position; and a third electrical contact portion disposed in the recoil buffer and electrically connected to the second electrical contact portion when the barrel is at a returned position, wherein the controller is connected to the third electrical contact portion and configured to transfer the laser oscillating signal to the third electrical contact portion.

7. The cannon of claim 6, wherein the first electrical contact portion comprises:

a first spring member;

a 1-1 contact member connected to one end of the first spring member to face the laser contact portion; and a 1-2 contact member connected to the other end of the first spring member opposite the 1-1 contact member, and the second electrical contact portion comprises:

a second spring member;

a 2-1 contact member connected to one end of the second spring member to face the 1-2 contact member; and a 2-2 contact member connected to the other end of the second spring member opposite the 2-1 contact member.

* * * * *